US010687635B2

(12) United States Patent
Jouhara et al.

(10) Patent No.: US 10,687,635 B2
(45) Date of Patent: Jun. 23, 2020

(54) HEAT TRANSFER APPARATUS

(71) Applicant: Flint Engineering Ltd, Mayfield (GB)

(72) Inventors: Hussam Jouhara, Manchester (GB); Savvas Tassou, Barnet (GB)

(73) Assignee: Flint Engineering Limited, Mayfield (GB)

( * ) Notice: Subject to any disclaimer, the term of this patent is extended or adjusted under 35 U.S.C. 154(b) by 0 days.

(21) Appl. No.: 15/538,626

(22) PCT Filed: Dec. 18, 2015

(86) PCT No.: PCT/GB2015/054074

§ 371 (c)(1),
(2) Date: Jun. 21, 2017

(87) PCT Pub. No.: WO2016/102937

PCT Pub. Date: Jun. 30, 2016

(65) Prior Publication Data

US 2018/0008061 A1 Jan. 11, 2018

(30) Foreign Application Priority Data

Dec. 23, 2014 (GB) ..... 1423037.9

(51) Int. Cl.
*A47F 3/04* (2006.01)
*F25D 25/02* (2006.01)
(Continued)

(52) U.S. Cl.
CPC ..... *A47F 3/0491* (2013.01); *F25D 25/028* (2013.01); *F28D 15/0233* (2013.01); *F25B 23/006* (2013.01); *F25D 11/006* (2013.01)

(58) Field of Classification Search
CPC ..... F25D 25/028; F28D 15/0233; F28F 1/02; F28F 1/06
(Continued)

(56) References Cited

U.S. PATENT DOCUMENTS 2,068,074 A 1/1937 Rodgers
2,334,284 A 11/1943 Philipp
(Continued)

FOREIGN PATENT DOCUMENTS

CN 201149408 * 11/2008 ..... F25D 25/02
CN 204580653 U 8/2015
(Continued)

OTHER PUBLICATIONS

International Search Report and Written Opinion dated May 11, 2016, International Patent Application No. PCT/GB2015/054074, filed Dec. 18, 2015, 14 pages.
(Continued)

*Primary Examiner* — Christopher R Zerphey
(74) *Attorney, Agent, or Firm* — McDonnell Boehnen Hulbert & Berghoff LLP

(57) ABSTRACT

Refrigerative shelving arrangement comprising a heat-absorbing shelf (10) formed from a panel having first and second main faces containing plural passages (50) for conveying a working fluid in both liquid and gaseous states around an interior portion of the shelf (10); and a condenser (35) in fluid communication with the heat-absorbing shelf (10), wherein the heat-absorbing shelf (10) and the condenser (35) form a hermetically sealed system configured to allow the working fluid to circulate between the heat-absorbing shelf (10) and the condenser (35) without a compressor.

20 Claims, 6 Drawing Sheets

(51) Int. Cl.
*F28D 15/02* (2006.01)
*F25B 23/00* (2006.01)
*F25D 11/00* (2006.01)

(58) Field of Classification Search
USPC ..... 62/520, 521
See application file for complete search history.

(56) References Cited

U.S. PATENT DOCUMENTS 2,386,919 A 10/1945 Tobey
4,306,616 A 12/1981 Woods, Jr. et al.
4,984,435 A * 1/1991 Seino ..... F25D 17/02 62/185
5,404,935 A * 4/1995 Liebermann ..... A21B 1/10 165/48.1
5,497,634 A * 3/1996 Kojima ..... F25D 17/065 62/441
5,960,866 A * 10/1999 Kimura ..... F28D 15/0233 165/104.19
8,161,762 B2 * 4/2012 Sugimoto ..... F25B 39/04 165/184
9,291,381 B2 * 3/2016 Nelson ..... F25C 1/00
2002/0033250 A1 * 3/2002 Chuang ..... F28D 15/0233 165/104.33
2004/0011077 A1 * 1/2004 Maidment ..... A47F 3/0447 62/465
2005/0173096 A1 * 8/2005 Hsu ..... F28D 15/0233 165/104.21
2008/0264611 A1 * 10/2008 Chang ..... H01L 21/4882 165/104.26
2011/0252813 A1 10/2011 Veltrop
2012/0047917 A1 * 3/2012 Rafalovich ..... F25D 11/025 62/66
2014/0041407 A1 2/2014 Bush

FOREIGN PATENT DOCUMENTS

EP 0382966 A1 8/1990
EP 1267137 A1 12/2002
JP H10206005 A 8/1998
JP 2009148355 A 7/2009
WO 200215752 A1 2/2002

OTHER PUBLICATIONS

Jmal et al., "Numerical study of PCM solidification in a finned tube thermal storage including natural convection," Applied Thermal Engineering vol. 84, Jun. 5, 2015, 11 pages.
Khalifa et al., "A numerical and experimental study of solidification around axially finned heat pipes for high temperature latent heat thermal energy storage units," Applied Thermal Engineering 70(1):609-19, Sep. 5, 2014.
United Kingdom Search Report dated Feb. 18, 2015, Patent Application No. GB1423037.9, filed Dec. 23, 2014, 4 pages.
Zhang et al., "Heat transfer enhancement in latent heat thermal energy storage system by using the internally finned tube," International Journal of Heat and Mass Transfer 39(15):3165-73, Oct. 1, 1996.
Zhang et al., "RT100/expand graphite composite phase change material with excellent structure stability, photo-thermal performance and good thermal reliability," Solar Energy Materials and Solar Cells 140:158-66, Sep. 30, 2015.

* cited by examiner

HEAT TRANSFER APPARATUS

CROSS-REFERENCE TO RELATED APPLICATIONS

This application is a national stage application of International Application No. PCT/GB2015/054074, filed on Dec. 18, 2015, which claims priority to United Kingdom Application No. 1423037.9, filed on Dec. 23, 2014.

FIELD

The present invention relates to a heat transfer apparatus.

BACKGROUND

Retailers currently have a very high spend on running display freezers. One of the reasons that the cost of these freezers is relatively high is that in order to guarantee food safety, the units have to operate so that the warmest parts of the freezer (known as hot spots) are maintained at or below the maximum permitted temperature for food storage. Such hot spots can occur for several reasons but are mainly due to the poor air flow around the shelves and the addition/movement of items on the shelf.

The invention was devised in this context.

SUMMARY

A first aspect of the invention provides a refrigerative shelving arrangement comprising a heat-absorbing shelf formed from a panel having first and second main faces containing plural passages for conveying a working fluid in both liquid and gaseous states around an interior portion of the shelf; and a condenser in fluid communication with the heat-absorbing shelf, wherein the heat-absorbing shelf and the condenser form a hermetically sealed system configured to allow the working fluid to circulate between the heat-absorbing shelf and the condenser without a compressor.

The condenser may be contained within an actively cooled region.

The condenser may be elevated relative to the heat-absorbing panel.

The condenser may comprise a pipe at least partially surrounded by condenser fins.

The condenser fins may be formed from a helical length of thermally conductive material.

The condenser fins may be formed from annular pieces of thermally conductive material.

The condenser may comprise a panel upstanding from the shelf, wherein the plural passages of the shelf may extend upwardly into the condenser.

The condenser may have plural elongate fins arranged around the exterior thereof.

Each fin may have a length similar to the length of the condenser panel.

The number of fins may be equal to the number of passages extending into the condenser.

Each of the passages may include one or more protruding features on a side of the passages that is closer to the upper surface of the shelf.

The arrangement may further comprise a layer of phase change material configured to change phase between a solid phase and a fluid phase, thereby storing heat.

The heat-absorbing shelf may be formed from aluminium.

A second aspect of the invention provides a refrigerative shelving system comprising at least one refrigerative shelving arrangement.

BRIEF DESCRIPTION OF THE DRAWINGS

So that the invention may be fully understood embodiments thereof will now be described, by way of example only, with reference to the following drawings, in which.

DETAILED DESCRIPTION

Figure 1:
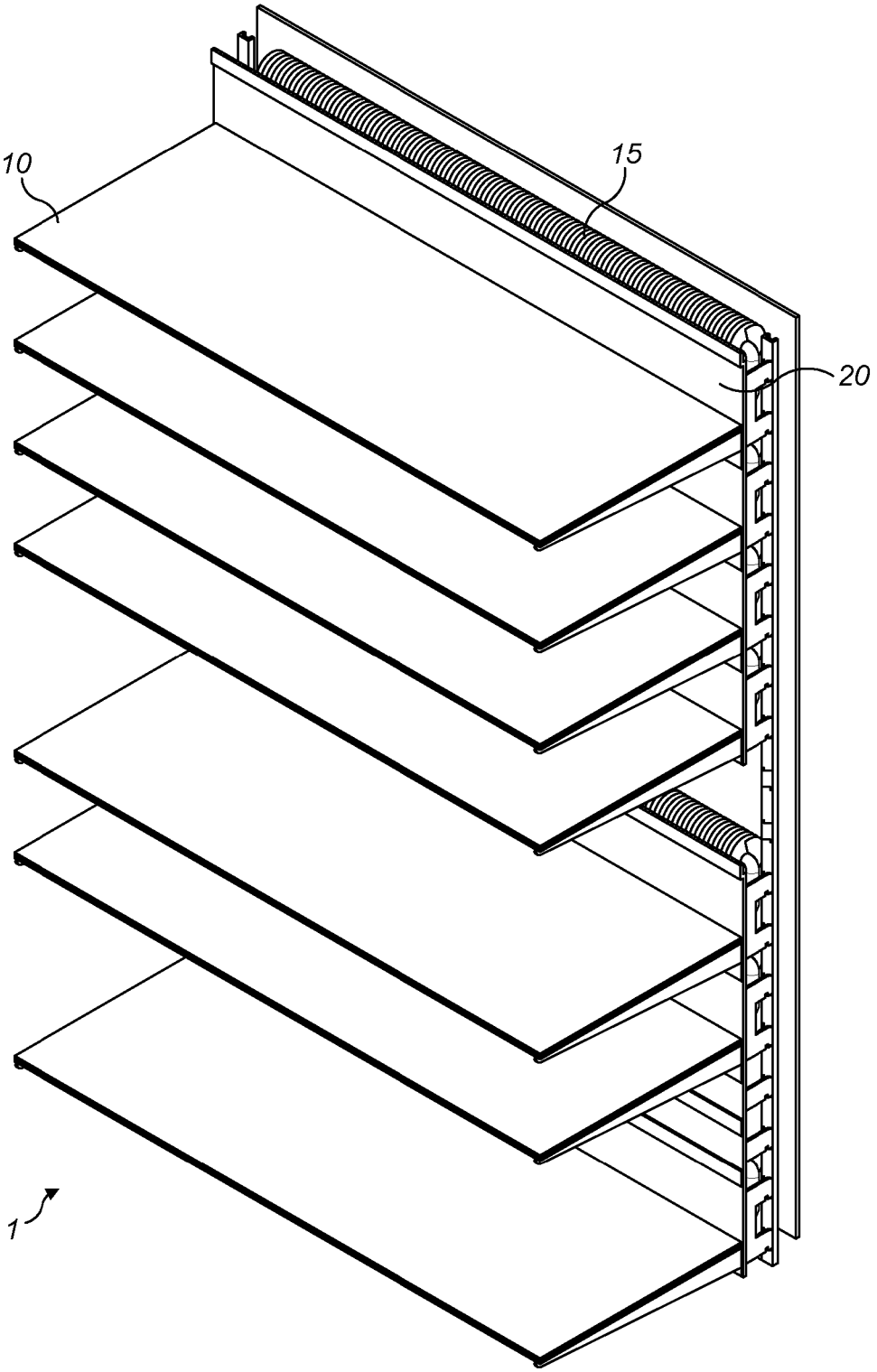
FIG. 1 shows a shelving unit in accordance with embodiments of the invention.

FIG. 1 shows a shelving unit 1 comprising several horizontal shelves 10 arranged on top of each other as part of a display freezer. The unit 1 forms a storage system suitable for storing items that are to be refrigerated. Example items include food, drinks or medical items. However, any goods that require cooling can be stored in the unit 1, especially goods that need to be stored below particular temperatures to comply with storage regulations.

As well as the shelves 10, the shelving unit 1 comprises a condensing region 15. The condensing region 15 contains condensers associated with each of the respective shelves 10. The condensing region 15 is separated from the storage area (i.e. the shelves 10) by a partition 20. The condenser region is actively cooled using a fan (not shown) although other cooling means could be used. The fan cools the condensing region 15 to a temperature approximately 2 degrees Celsius below the temperature of the shelf. This provides a temperature differential between the condenser region 15 and the shelf 10 which helps the heat exchange as described in more detail below.

The shelving unit 1 shown in FIG. 1 is arranged to store goods in a temperature range of between approximately minus 10 degrees Celsius and normal room temperature (approximately 20 degrees Celsius).

Figure 2:
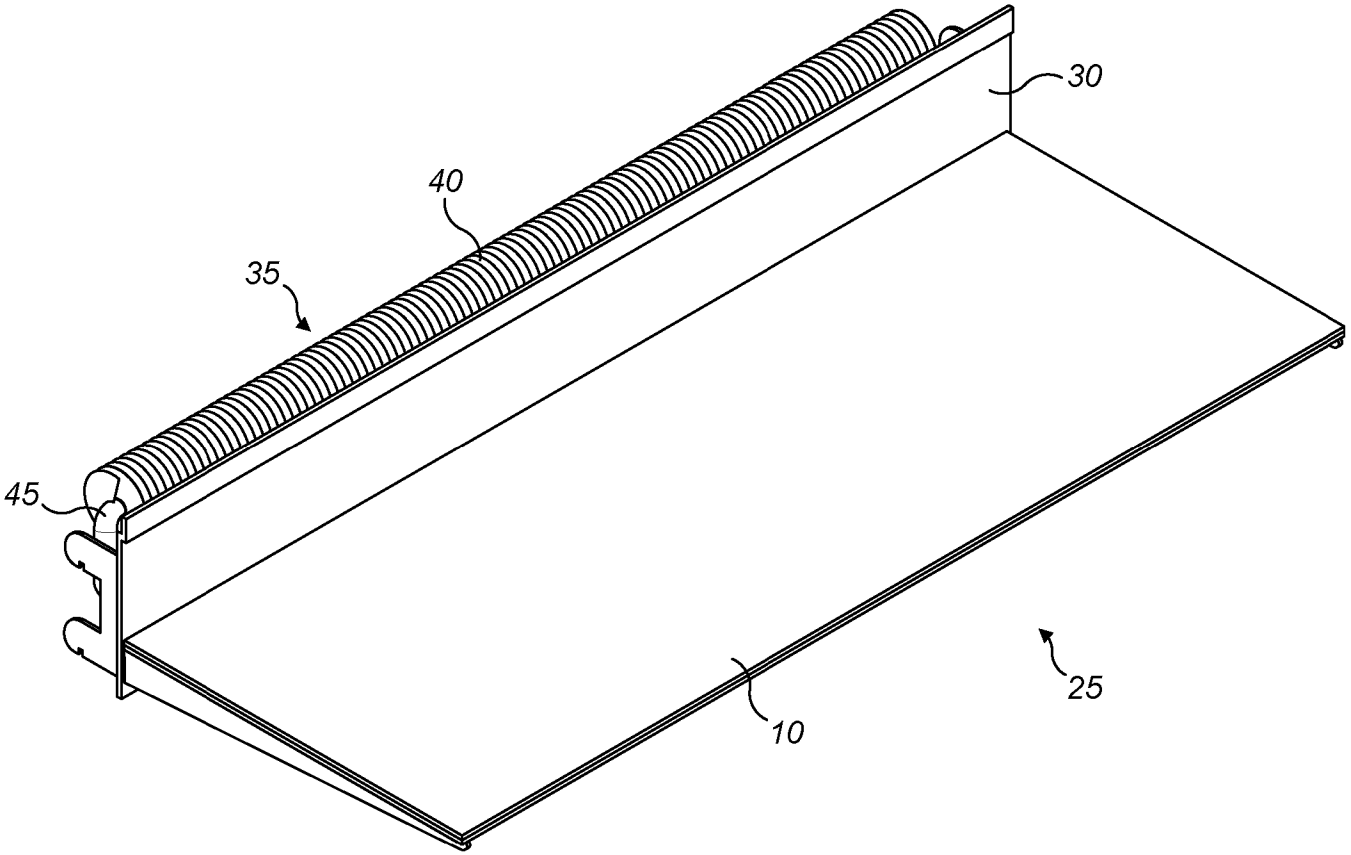
FIG. 2 shows a shelving arrangement in accordance with one embodiment of the invention.

FIG. 2 shows an individual shelving arrangement 25 according to a first embodiment of the invention. The shelving arrangement 25 comprises a shelf 10 supported by a pair of brackets 25, one of which is shown in FIG. 2. A backing panel 30 is provided towards the rear of the shelf 10 and acts as part of the partition 20 in the vicinity of the individual shelving arrangement 25 of FIG. 2.

A condenser 35 is situated behind the shelf 10. The condenser 35 is located behind the backing panel 30 and is contained inside the condensing region 15 of the shelving unit 1 shown in FIG. 1.

The condenser 35 takes the form of a tube extending substantially alongside the length dimension of the shelf 10. The tube is provided with fins 40. The fins 40 facilitate the condensation of working fluid located within the condenser 35 by virtue of increasing the condenser's surface area. The fins 40 shown in FIG. 2 are formed from a helical length of metal or other thermally conductive material wrapped around the condenser tube. Alternatively, the fins 40 may be formed from separate annular pieces of thermally conductive material wrapped around the condenser tube. In either case, the heat transfer has been found to be efficient. Using a single length of material to form a helical set of fins is advantageous because it is easier to manufacture. The finned tube can be made out of polymer or any other suitable material. The helical and circular configurations allow air to flow around both sides of the fins, thereby providing a greater exposed surface area to the chilled air flow inside the condenser region.

The condenser 35 is connected to the shelf 10 by connecting tubes 45 at either end thereof. The connecting tubes 45 are linked with internal passages of the shelf which are described in more detail below. As such, the shelf 10 and the condenser 35 are in fluid communication and form a substantially hermetically sealed system.

The connecting tubes 45 extend upwardly with respect to the plane of the shelf 10 so that the condenser 35 is elevated with respect to the shelf 10. Providing the condenser above the shelf is advantageous because it allows condensed working fluid in the liquid phase to move from the condenser 35 to the shelf 10 under gravity.

Figure 3:
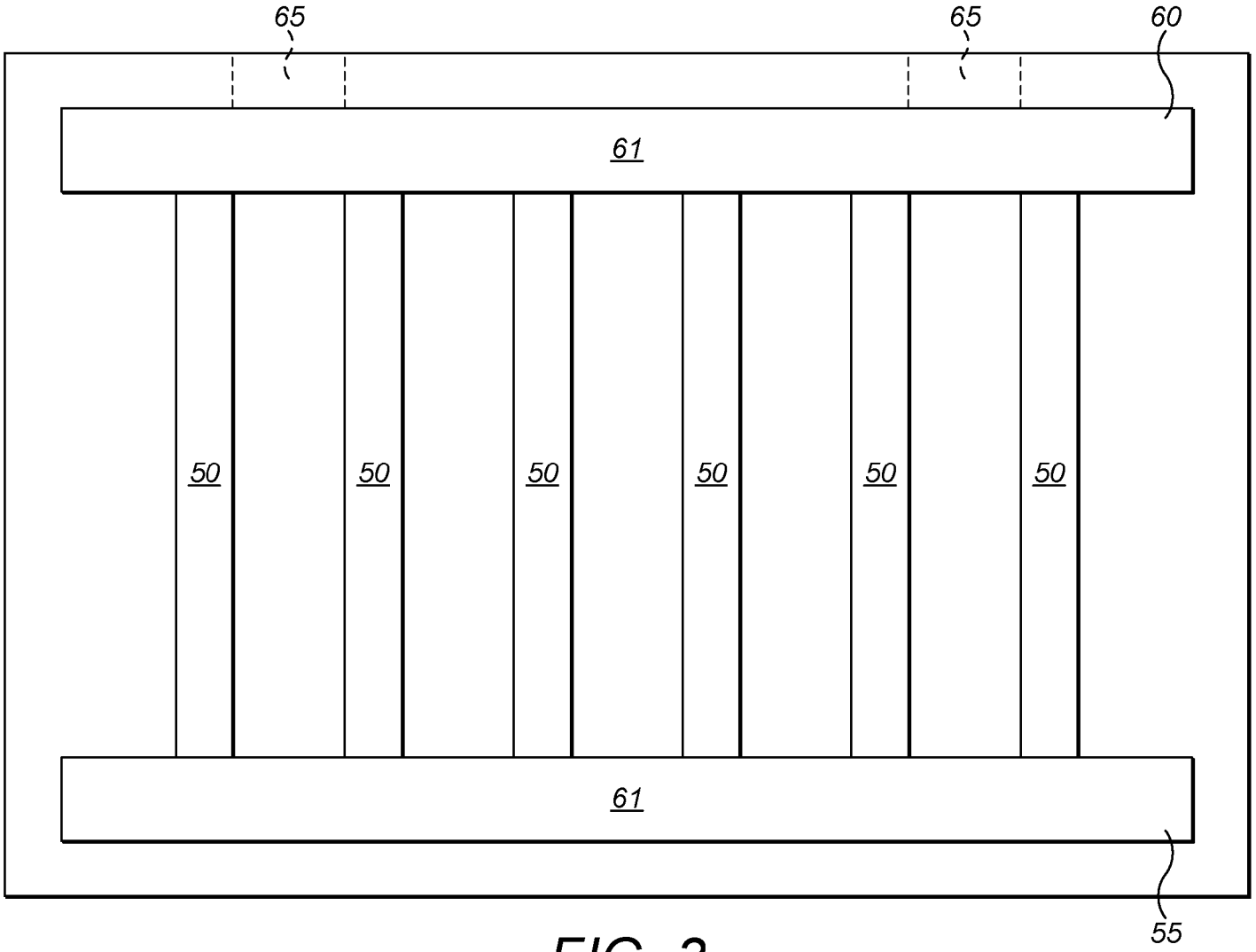
FIG. 3 shows schematically the internal structure of a shelf in accordance with the embodiment shown in FIG. 2.

FIG. 3 shows the internal structure of the shelf 10. Extending within the body of the shelf 10 are plural passages 50. The passages 50 are equally spaced across the length of the shelf 10. Each of the passages 50 terminates at a front manifold 55 and a rear manifold 60. The connecting tubes 45 connect to connections 65 so that the condenser 35 is in fluid communication with the interior of the shelf 10. The configuration of the passages 50 is described in more detail below, particularly with reference to FIG. 5.

Figure 4:
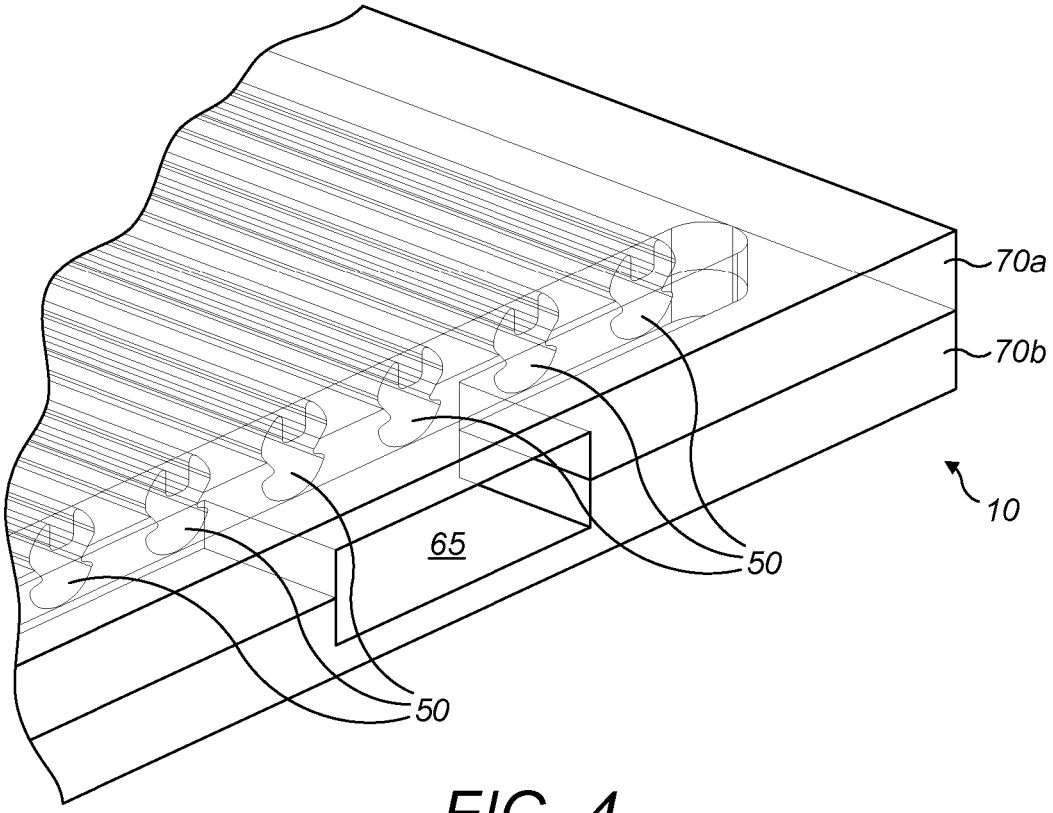
FIG. 4 is an alternative view of the internal structure of a shelf in accordance with the embodiment shown in FIG. 2.

FIG. 4 shows an alternative view of the ends of the passages 60 towards the rear of the shelf 10. As can be seen from FIG. 4, the shelf is formed from a first panel 70*a* and second panel 70*b* that can be welded together to form the main body of the shelf 10.

Figure 5:
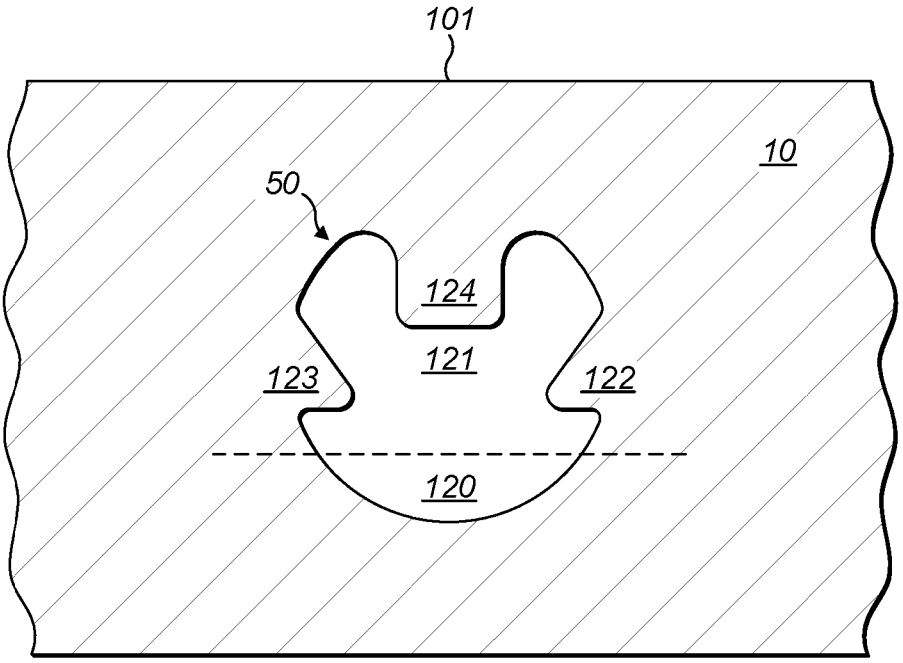
FIG. 5 is a cross-sectional view of one of the passages contained within a shelf in accordance with the embodiment shown in FIG. 2.

The cross section of the passages 50 is shown in FIG. 5. As can be seen from FIG. 5, the passage 50 has a generally circular shape and includes a number of features. The passage 50 can be divided conceptually into two parts: a phase-change portion 121 and a drain channel 120. The divider between the drain channel 120 and the phase-change portion 121 is a straight line that is horizontal in FIG. 5. The divider is located approximately one quarter of the distance between the part of the passage 50 that is furthest from the upper face 101 and the part of the passage 50 that is closest to the upper face 101. However, the divider could instead be located anywhere between 10% and 50% of the way along the depth of the passage as defined from the part of the passage 50 that is most distant from the upper face 101 and the part of the passage 50 that is closest to the exterior face 101.

Each of the passages 50 is provided with ribs 122, 123, 124. The effect of the ribs 122, 123, 124 is to provide an increased surface area between the material of the shelf main body and the cavity that is the passage 50. The ribs 122, 123, 124 are constructed so as to facilitate straightforward manufacture of the shelf 10. In particular, corners of the ribs are filleted. Also, the thicknesses of the ribs are sufficiently high that they can be reliably formed through manufacture without breakage.

The passages 50 have an overall width of approximately 6 mm. Approximately 15% of the area of a circle including the passages is occupied by the volume of the ribs 122, 123, 124. The volume of the circle including the passages that is occupied by the volume of the ribs may be for instance 5-35%.

As is best seen in FIG. 3, one manifold 55, 60 is provided at each end of the shelf 10. Each of the manifolds 55, 60 includes a manifold channel 61. The manifold channel 61 serves to connect the passages 50, to allow the working fluid to flow between the passages 50. The provision of front and rear manifolds 55, 60 means that all of the passages 50 are connected together at their front ends and at their rear ends.

The manifolds 55, 60 are substantially straight. The manifolds 55, 60 are formed of the same material as the main body of the shelf. The manifold 55, 60 has a substantially straight channel running along the entire length of the inner face (i.e. the face that is facing the open passages 50). The channel has a rectangular cross-section, although it may instead be for instance part-circular for better pressure characteristics. The effect of this channel is to commonly terminate all the passages 50 as shown in FIG. 3, allowing the working fluid to pass through freely and equalising the pressure when the shelf 10 is in operation. The material of the manifold is of a suitable minimum thickness, for instance 2 mm or 2.5 mm.

The height of the manifold channel 61 may be smaller than the width of the passages 50. The main effect of the manifold channel 61 is to allow pressure to be equalised between the ends of the passages 50. The cross-sectional area of the manifold channel may alternatively be approximately the same as the cross-sectional area of the passages. The cross sectional area of the manifold cavities may for instance be 50-200% the cross sectional area of the passages.

The passages 50 within the main body of the shelf 10 are commonly terminated at each end of the shelf 10 by the manifolds 55 and 60, sealing the passages 50 which, in turn, form a liquid- and gas-tight chamber as shown in FIG. 3.

The interior cavities of the shelf 10, comprising the passages 50 and the manifold channels 61, are provided with a volume of fluid. In particular, some of the fluid is in liquid phase and some of the fluid is in gas phase. When the condenser 35 is connected to the shelf 10 via the connections 65 and connecting tubes 45, the cavity comprising the passages 50 and the manifold channels 61 form a substantially closed system with the condenser 35. The pressure within the cavity may be above or below atmospheric pressure, depending on the choice of fluid.

Contained within the sealed chamber is a working fluid that is fundamental to the heat exchanging process. There are a multitude of working fluids that can be used including water, ammonia, acetone, alcohols and blends thereof, the efficacy of these are driven by the conditions in which the panel is used. The skilled person will be able to identify suitable fluids for any given set of working conditions. In particular, while embodiments described herein are configured to store goods between approximately minus 10 degrees Celsius and normal room temperature (approximately 20 degrees Celsius), alternative working fluids may be selected to achieve a different temperature operating range.

In use, the shelf absorbs heat from the region surrounding the shelf 10. As such, the region surrounding the shelf 10 is cooled substantially. The heat energy evaporates the working fluid, turning it from liquid to vapour through the absorption of the latent heat of evaporation. The evaporated portion of the working fluid expands and moves towards the actively cooled condenser 35. The evaporated portion of the working fluid rises and moves towards the colder condenser region because of the temperature gradient. Therefore, by keeping the condenser relatively cool and elevated with respect to the shelf 10, the evaporated fluid will move towards the condenser.

Once cooled inside the condenser, the evaporated portion of the working fluid condenses. This creates a low pressure region in the condenser. This pressure drop also helps to attract more evaporated fluid from the shelf 10.

Upon condensing, the vapour releases the stored latent heat to the cool air inside the condenser that is adjacent to the condenser 35. The heat is released to the air in the condenser region via radiation. The fins 40 help to transfer the heat to the surrounding air in the condenser region. By actively cooling the condenser region, the condensation of the working fluid back to the liquid phase is completed more efficiently.

The condensed liquid travels down the connecting tube 45 by the action of gravity and returns to the interior of the shelf 10. The vaporization-condensation cycle can then repeat again. Elevating the condenser 35 with respect to the shelf 10 allows for return of the working fluid in the liquid phase without the need to use any wicking structures. Furthermore, the circulation of the working fluid between the shelf and the condenser can be performed without using a compressor.

As stated above, the effect of the ribs 122, 123, 124 is to provide an increased surface area between an upper surface of the shelf 10 and part of the cavity that is the phase change portion of the passage 50. This improves the phase-change process as more heat can flow between the upper surface and the working fluid within the sealed chamber per unit time, compared to an arrangement that is absent of ribs. The surface area of the phase-change portion 121 is greater per unit volume than the surface area of the drain channel 120. The profile of the passages is not limited to that shown in FIG. 5. For example, the main rib 124 can be narrower (whilst having the minimum width needed for mechanical stability and manufacturability). Optionally, one or more additional ribs could be provided in place. Similarly, the ribs 122 and 123 can also be narrower. The ribs may be of any suitable profile, for instance rectangular, square, triangular or convex rounded. They may alternatively have a more complex profile, such as a part-trefoil or part-clover-leaf profile. The features 122, 123 and 124 are ribs because they extend longitudinally along the length of the passages 50. If manufacturing allows, other internal features of the passages that change the surface area of the phase change portion may be used instead of ribs.

The profile of the phase change portion 121 of the passages 50 maximises the transfer of heat energy from the upper surface 101 to the passages whilst allowing the upper surface 101 to be planar, whilst allowing a minimum wall thickness (e.g. 2 mm or 2.5 mm) to be maintained and whilst allowing relatively straightforward manufacture of the shelf 10.

The ribs 122-124 are easy to manufacture by extrusion because they have a constant profile along the length of the passages 50. Instead, protrusions of other forms may be present in the passages. The protrusions may be domed, or they may be circumferential or helical ribs or may take any other suitable form, as permitted by the manufacturing process chosen for producing the shelf 10.

The main body of the shelf 10 and the manifolds 55, 60 advantageously are formed of aluminium, which is relatively inexpensive, has good anti-corrosion properties, and is easy to work in a manufacturing process. Alternatively, an aluminium alloy or another metal such as steel may be used.

The shelf can be manufactured in several ways. For example, as stated above the shelf can be formed from two moulded panels and then welded together. This method can be used for shelves made from sheet metals as well as those made from polymers.

The shelving arrangement can also be produced by the joining together of several parts for instance the thermal mat area of the shelf could be extruded in either metal or polymer. This has the advantage of being able to produce intricate designs within the pipe. The ends of these extrusions are then capped with moulded end caps housing the connection pipes and the connections to the condenser. The condenser can then be either an extruded or moulded unit; either moulded with the end caps or as a separate unit. Where the multi-section combined moulding and extrusion method is used it allows for the use of different materials best suited for the required function. It is also possible either to manufacture the shelf with integral strength to make it self supporting or to make it an add-on unit to be fitted on to an existing shelving unit such as a chiller cabinet.

Figure 6:
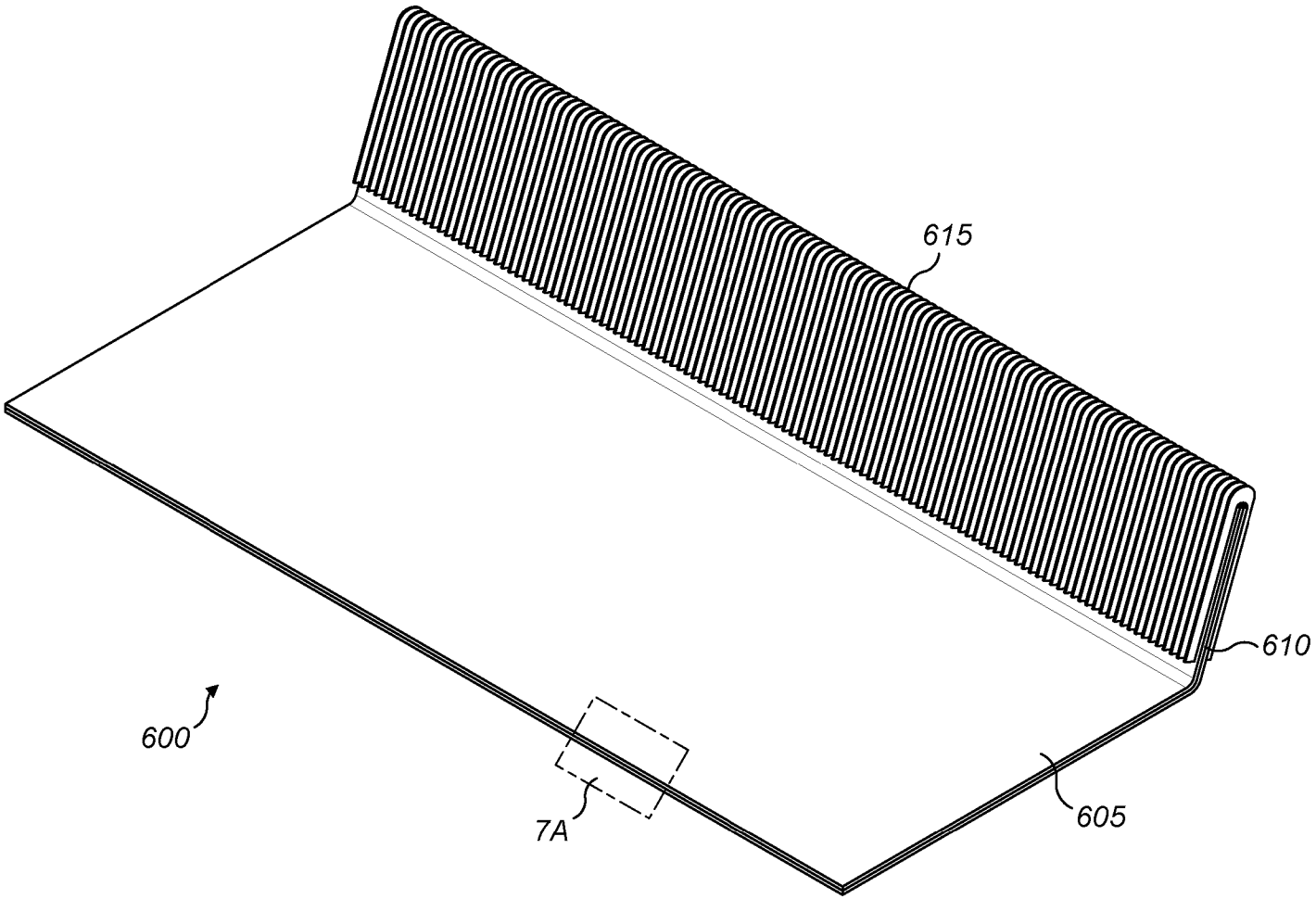
FIG. 6 shows a shelving arrangement in accordance with a second embodiment of the invention.
Figure 7A:
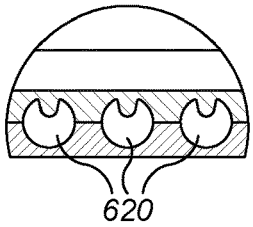
FIG. 7 shows various exploded views of parts of the shelving arrangement of the second embodiment.
Figure 7B:
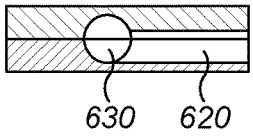
Figure 7C:
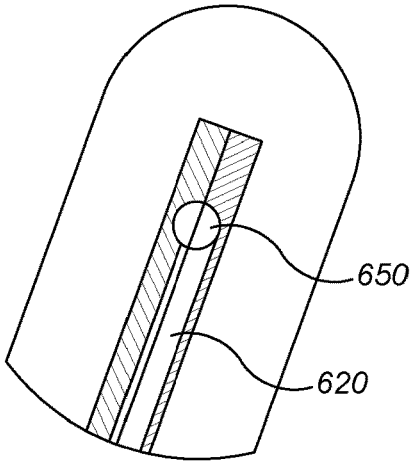

FIG. 6 shows a shelf arrangement 600 according to another embodiment. The shelf arrangement 600 comprises a substantially horizontal shelf part 605 and an inclined condenser part 610. The horizontal shelf part 605 and the inclined condenser part 610 can be formed integrally with respect to each other. The shelf arrangement 600 comprises passages 620 that extend from a front manifold 630 (as shown in FIG. 7B) substantially similar to the front manifold 55 shown in FIG. 3. Passages 620 are provided in the shelf part 605, as shown in FIG. 7A, that are similar to the passages 50 provided with the shelf 10 except that the passages 620 extend into the condenser part 610 and terminate at a rear manifold 650 disposed at the top of the condenser part 610, as shown in FIG. 7C. Fins 650 are provided around the condenser part 610. Each fin can be provided to surround a respective passage 640. A backing board (not shown) can be provided to separate the storage region and the condenser region which can be actively cooled in the same way as the condenser region 15 shown in FIG. 1.

The shelf arrangement 600 works in substantially the same way as the shelving arrangement 25. Working fluid located in the passages 640 inside the horizontal shelf part 605 evaporates and moves into the condenser part where the heat is released and the fluid condenses, falls under gravity and returns to the horizontal shelf part 605. The evaporation-condensation then repeats itself.

The shelves 10, 605 can be made using extruded aluminium mats however preferred embodiments use thermally conductive plastics using both extrusion and moulding techniques.

Shelving units according to embodiments of the invention can be manufactured as new units or the shelving arrangements can retrofitted to existing refrigeration cabinets. The shelving arrangements can be retrofitted because they do not require compressors to pump refrigerant around the system.

The skilled person will recognise at least the following advantages to the shelving arrangements described herein:

1) More even temperature control within the refrigeration area. Shelves made according to embodiments of the invention provide an even and consistent temperature profile across the surface and in the vicinity of the shelf. As such, the occurrence of 'hot spots' is greatly reduced.

2) Lower electrical cost refrigeration. The reduction in hot spots means that less energy has to be expended cooling the shelving unit to a colder temperature to ensure compliance with temperature requirements.

3) Better temperature control of products stored on the shelves because there is less variation in temperature across the surface of the shelves.

4) The shelving arrangements can be retrofitted to existing refrigeration cabinets so that it is not necessary to build the entire unit from scratch.

Thermal Storage System

Figure 8:
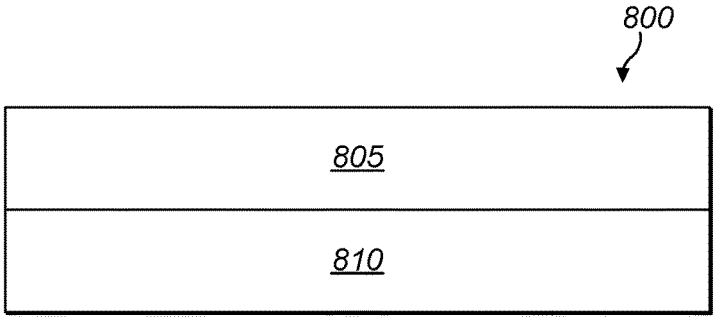
FIG. 8 shows a shelving arrangement having a thermal storage part.

With the active removal of the heat from the shelf area it is possible to build in to the shelf an area of thermal storage. FIG. 8 shows an end-on view of a shelving arrangement 800 substantially similar to the shelving arrangements 25, 600. The shelving arrangement 800 comprises a shelf 805 substantially similar to the shelves described above. The shelving arrangement 805 further comprises a layer of phase change material (PCM) 810 located below the lower face of the shelf 805.

The layer 810 is a container holding a phase change material (PCM) such as brine, water, paraffin or wax arranged to change state between solid and fluid at the level of temperature required by the shelf. The selection of PCM will change dependent on unit use.

During periods of either low cost or over production of electricity (such as at night) the chiller is run over a sufficiently long period to extract heat from the phase change material, thereby turning it to a solid. During the day the shelf may be configured to maintain its required temperature. If there is a power outage or peak in demand requiring chillers to be turned off or the temperature rises beyond a certain point that the chiller can support then the PCM will start to return to a fluid absorbing the local heat and keeping the temperature in the vicinity of the shelf below a threshold temperature.

This feature has several advantages. It allows for planned use of electricity as energy from periods of low demand can be stored. The unit can then be turned off at times of high energy demand. As such, the system provides an environmentally friendly way of operating a chiller cabinet. Furthermore, temperature-sensitive goods stored in the cabinet can be protected from power outages. The system also allows for smoothing of load on the shelf when goods are added and removed.

Experiments have been Carried Out on Shelving Systems in Accordance with Embodiments of the Present Invention in Comparison with Known Shelving Systems.

Working Environmental Constraints

The working environmental constrains are continuous operation in food retail stores over 24 hours a day and 7 days a week, in which the room temperature is 20° C. and the relative humidity is 50%. The shelves have to withstand ambient temperatures up to 80° C. safely to comply with regulatory requirements.

Energy Transfer Requirements

The energy requirements are the same with any conventional open display cabinet. These are to sustain the food products at 5° C. or less. In conventional cabinets, this is done by forcing cold air through the shelves to utilise forced convection heat transfer mechanisms that will absorb any heating loads from the ambient to the food.

The heat pipe shelving arrangements 25, 600 described in the above embodiments, in addition to the forced convection mechanism, adds a conduction mechanism. Heat from ambient air and food stored on the shelf is absorbed and transferred by conduction from the upper face 101 and through the panel 70*a* of the heat mat to the internal passages 50 of the shelf which forms the heat pipe evaporator.

In addition, there is a natural convection mechanism from the bottom of the shelf to the food at the shelf below. The heat pipe shelf 10 will also absorb radiative heat as its surfaces are actively cooled by the heat pipe mechanism. These new heat transfer mechanisms, in addition to the isothermal working temperature of the shelf surface, will ensure the food is sustained at the desired temperature using less energy, which has been proven in experiments.

In some embodiments, the selected working fluid is ammonia because of its superior heat transfer properties when compared to other refrigerants. Based on this combination and the simulation that was done, this means that the designed shelf must be able to withstand an internal pressure up to 150 Bar safely. The shelf 10 may be formed from a polymer or aluminium.

Viability—Polymer Versus Aluminium

Investigated materials for manufacturing the shelf were different polymers and aluminium. Four polymers have been identified as potentially viable from a thermal transfer prospective:

i) PRETHERM TP 14112
ii) PRETHERM TP 14113
iii) PRETHERM TP 14114
iv) Borotron UH050

Table 1 below summarizes the physical properties of the above polymers.

TABLE 1

| Property | TP14112 | TP14113 | TP14114 | UH050 | Aluminium |
|---|---|---|---|---|---|
| Thermal conductivity [W/m * K] | 0.50 | 0.55 | 0.60 | 0.80 | 205 |
| Tensile Strength [MPa] | 22 | 15 | 12 | 16 | 276 |
| Density [g/cm$^3$] | 1.05 | 1.08 | 1.12 | 1.005 | 2.70 |
| Charpy Impact Test [kJ/m$^2$] | 10 | 9 | 6 | 15 | 4.83 |
| Flexural modulus [MPa] | 950 | 1050 | 1220 | 900 | 73100 |

Moreover, polymers are suitable for extruding and moulding, however their operation is constrained by the following issues:

With the working constraints, the shelf has to withstand temperatures below freezing (0° C.).

The shelf has to withstand temperatures above 80° C.

In order to address these issues, polymers would be too thick to allow moulding thereof. For that reason a moulded polymer is not viable for the shelf with the above operating range, although it could be used where a narrower operating range is required.

In experiments conducted with different materials, it has been found that aluminium is stronger, less porous and overall is lighter than polymer shelves.

Working Fluid

The selection of the type of phase change material (PCM) that is used as a working fluid is based on several considerations like the operating temperature, the latent heat of vaporization, the liquid viscosity, the toxicity, the chemical compatibility with the container material, the wicking system design (if present) and the performance requirements. Optimal performance for a heat pipe may be obtained by utilizing a working fluid that has a high surface tension, a high latent heat and a low liquid viscosity.

The most popular working fluids compatible with aluminium are ammonia and acetone, however, ammonia is the most readily available. Many heat pipes for room temperature applications use ammonia; below the freezing point of water and above about −73° C., ammonia is an excellent working fluid.

| Working Fluids | Melting Point [° C.] | Boiling Point [° C.] | Latent Heat [kJ/kg] |
|---|---|---|---|
| Ammonia | −77.73 | −33.34 | 1180 |
| Acetone | −95 | 56 | 518 |

The solid-to-liquid PCM considered for thermal storage was 'va-Q-accu+4° C.', with melting point of 2° C. and latent heat of 180 kJ/kg.

Tests were run on a cabinet corresponding to the shelving system shown in FIG. 1 comprising multiple shelving arrangements 25 shown in FIG. 2. The tests were run in open lab conditions which correspond to the real environmental constraints of retail food outlets. The temperature distribution at different points on the shelves was monitored using food blocks having thermocouples incorporated therein. The thermocouples were positioned in contact with the shelves. Rock wool and insulation tape were used to insulate thermocouples from air. The same tests were also run on a conventional cabinet that uses convection cooling.

A 64-channel data acquisition (DAQ) system controlled by LabVIEW Real-Time software (National Instruments Corporation) was used for collection of experimental data. The DAQ system consisted of a CompactDAQ chassis that held three 16-channel thermocouple amplifier modules connected to the controller's terminal blocks. The output signals were transmitted to a touch screen monitor.

A program written in LabVIEW Real-Time controlled the DAQ system and recorded the data in real time. The CompactDAQ controller had an integrated 1.33 GHz dual-core Intel Atom processor, while the thermocouple amplifier modules were K-type supported, with built-in CJC and capable of reading temperatures between −40° C. to 70° C. Two configurations of K-type thermocouple were used in the experiments. For reading the core temperatures of the food products stainless steel K-type insulated thermocouples of 1.0×250 mm, with sensed temperature range of −100° C. to 1100° C. were used; while for collecting temperature readings of the ambient air, the surface of the shelves and the air on the back of the cabinet K-type thermocouples were constructed from scratch. A PFA insulated flat pair extension cable of K-type wires was used. The wire legs of thermocouples are typically made from different metals. The procedure of constructing a thermocouple starts with the stripping back of the outer insulation of the cable and then the stripping back of the insulation of each individual wire, in order to expose about 1 cm of the wires. Finally, the wires were bent to make a contact point, in which the wires were welded together creating a junction. This junction is where the temperature of a contacted surface or medium is measured.

For measuring and recording the consumption of the open display cabinets, two power energy data loggers PEL 103 (Chauvin Arnoux Group) were used. The PEL 103 is capable of collecting data regarding voltage, current, power, energy, phase and voltage and current harmonics and recording them on SD card or analyses them on real-time with a PC connection.

Food temperatures were colder by 0.8° C. with the shelving system used in embodiments of the invention compared with that used in conventional systems. Energy consumption was reduced by around 7% at same set point temperature with the shelving system used in embodiments of the invention compared with that used in conventional systems. Furthermore, energy consumption was reduced by 15% at the same food temperature with the shelving system used in embodiments of the invention compared with that used in conventional systems.

The invention claimed is:

1. A refrigerative shelving system comprising an actively cooled region;

a storage region separated from the actively cooled region by a partition; and at least one removable refrigerative shelving arrangement, each refrigerative shelving arrangement comprising:

a horizontally-extending heat-absorbing shelf formed from a panel having a first upper main face and a second lower main face, the panel containing a plurality of first passages disposed between the first upper main face and the second lower main face, the passages having a working fluid disposed therein, the passages being configured to convey the working fluid in both liquid and gaseous states around an interior portion of the heat-absorbing shelf, wherein the first passages are formed from internal cavities of the heat-absorbing shelf, the heat-absorbing shelf extending into the storage region of the shelving unit, wherein in each refrigerative shelving arrangement each of the first passages has a cross-sectional profile having a depth, an upper phase change portion disposed toward the first upper main face of the panel and a lower drain channel portion disposed toward the second lower main face of the panel, wherein the upper phase change portion of the cross-sectional profile has one or more protruding features formed therein, the protruding features protruding into the passages, and the lower drain channel portion of the cross-sectional profile lacks protruding features, the lower drain channel portion occupying in the range of 10% and 50% of the depth of the cross-sectional profile;

a condenser in fluid communication with the heat-absorbing shelf, wherein the heat-absorbing shelf and the condenser form a hermetically sealed system configured to allow the working fluid to circulate between the heat-absorbing shelf and the condenser without requiring a compressor to effect such circulation, wherein the condenser is contained within the actively cooled region and is elevated relative to the heat-absorbing shelf; and a backing panel extending vertically from the heat-absorbing shelf, the backing panel forming part of the partition separating the actively-cooled region from the storage region.

2. The refrigerative shelving system of claim 1, wherein in each refrigerative shelving arrangement the condenser comprises a pipe at least partially surrounded by condenser fins.

3. The refrigerative shelving system of claim 2, wherein in each refrigerative shelving arrangement the condenser fins are formed from a helical length of thermally conductive material.

4. The refrigerative shelving system of claim 2, wherein in each refrigerative shelving arrangement the condenser fins are formed from annular pieces of thermally conductive material.

5. The refrigerative shelving system of claim 1, wherein in each refrigerative shelving arrangement the condenser comprises a condenser panel upstanding from the heat-absorbing shelf, wherein the plural passages of the heat-absorbing shelf extend upwardly into the condenser.

6. The refrigerative shelving system of claim 5, wherein in each refrigerative shelving arrangement the condenser has plural elongate fins arranged around an exterior of the condenser.

7. The refrigerative shelving system of claim 6, wherein in each refrigerative shelving arrangement each fin of the plural elongate fins has a length similar to a length of the condenser panel.

8. The refrigerative shelving system of claim 6, wherein in each refrigerative shelving arrangement a number of the plural elongate fins is equal to a number of the passages extending into the condenser.

9. The refrigerative shelving system of claim 1, wherein each refrigerative shelving arrangement further comprises a layer of phase change material configured to change phase between a solid phase and a fluid phase, thereby storing heat.

10. The refrigerative shelving system of claim 1, wherein in each refrigerative shelving arrangement the heat-absorbing shelf is formed from aluminium.

11. The refrigerative shelving system of claim 1, wherein in each refrigerative shelving arrangement, the condenser comprises an upstanding panel upstanding from the heat-absorbing shelf.

12. The refrigerative shelving system of claim 11, wherein in each refrigerative shelving arrangement the plural passages of the heat-absorbing shelf extend upwardly into the condenser.

13. The refrigerative shelving system of claim 11, wherein the condenser is inclined relative to the heat-absorbing shelf.

14. The refrigerative shelving system of claim 11, wherein the heat-absorbing shelf and condenser are formed integrally with respect to each other.

15. The refrigerative shelving system of claim 11, wherein the heat-absorbing shelf and condenser are formed as extruded components.

16. The refrigerative shelving system of claim 11, wherein each of the passages includes one or more protruding features on a side of the passages that is closer to an upper surface of the heat-absorbing shelf.

17. The refrigerative shelving system of claim 11, wherein the heat-absorbing shelf is formed from aluminium.

18. A refrigerative shelving system comprising an actively cooled condenser region;

a storage region separated from the actively cooled condenser region by a partition; and at least one refrigerative shelving arrangement, each refrigerated shelving arrangement comprising:

a horizontally-extending heat-absorbing shelf formed from a panel having a first upper main face and a second lower main face, the panel containing a plurality of first passages disposed between the first upper main face and the second lower main face, the passages having a working fluid disposed therein, the passages being configured to convey the working fluid in both liquid and gaseous states around an interior portion of the heat-absorbing shelf, wherein the first passages are formed from internal cavities of the heat-absorbing shelf, the heat-absorbing shelf extending into the storage region of the shelving unit, wherein each of the first passages has a cross-sectional profile having a depth, an upper phase change portion disposed toward the first upper main face of the panel and a lower drain channel portion disposed toward the second lower main face of the panel, wherein the upper phase change portion of the cross-sectional profile has one or more protruding features formed therein, the protruding features protruding into the passages, and the lower drain channel portion of the cross-sectional profile lacks protruding features, the lower drain channel portion occupying in the range of 10% and 50% of the depth of the cross-sectional profile; and a condenser in fluid communication with the heat-absorbing shelf, wherein the heat-absorbing shelf and the condenser form a hermetically sealed system configured to allow the working fluid to circulate between the heat-absorbing shelf and the condenser without requiring a compressor to effect such circulation, wherein the condenser is contained within the actively cooled condenser region and is elevated relative to the heat-absorbing shelf.

19. The refrigerative shelving system of claim 18, wherein in each refrigerative shelving arrangement the condenser comprises a pipe at least partially surrounded by condenser fins.

20. The refrigerative shelving system of claim 18, wherein in each refrigerative shelving arrangement the condenser comprises a condenser panel upstanding from the heat-absorbing shelf, wherein the plural passages of the heat-absorbing shelf extend upwardly into the condenser.

* * * * *